US005314306A

United States Patent [19]

Beiss et al.

[11] Patent Number: 5,314,306

[45] Date of Patent: May 24, 1994

[54] FRAME FOR PUMP-MOTOR ASSEMBLIES

[75] Inventors: Günter Beiss, Bremen; Horst Schäfer, Rhade, both of Fed. Rep. of Germany

[73] Assignee: KSB Aktiengesellschaft, Frankenthal/Pfalz, Fed. Rep. of Germany

[21] Appl. No.: 40,169

[22] Filed: Mar. 30, 1993

[30] Foreign Application Priority Data

Apr. 2, 1992 [DE] Fed. Rep. of Germany ..... 4211033

[51] Int. Cl.[5] ..... F01D 25/28

[52] U.S. Cl. ..... 415/213.1

[58] Field of Search ..... 415/213.1, 214.1, 182.1

[56] References Cited

U.S. PATENT DOCUMENTS

| | | | |
|---|---|---|---|
| 1,863,213 | 6/1932 | Wintroath | 415/182.1 |
| 2,150,101 | 3/1939 | Lee | 415/213.1 |
| 2,625,110 | 1/1953 | Haentjens et al. | 415/213.1 |
| 2,934,245 | 4/1960 | Emeny | 415/182.1 |
| 3,733,151 | 5/1973 | Timmons et al. | 415/213.1 |
| 3,738,782 | 6/1973 | Fraser | 415/213.1 |
| 4,138,201 | 2/1979 | Dernedde et al. | 415/213.1 |
| 4,360,314 | 11/1982 | Pennell | 415/182.1 |

FOREIGN PATENT DOCUMENTS

| | | | |
|---|---|---|---|
| 849957 | 9/1952 | Fed. Rep. of Germany | 415/182.1 |
| 1135765 | 8/1962 | Fed. Rep. of Germany . | |
| 893675 | 8/1944 | France | 415/182.1 |
| 1022489 | 3/1953 | France | 415/213.1 |
| 954614 | 8/1982 | U.S.S.R. | 415/213.1 |
| 911769 | 11/1962 | United Kingdom . | |

*Primary Examiner*—John T. Kwon

*Attorney, Agent, or Firm*—Darby & Darby

[57] ABSTRACT

The casing of a centrifugal pump is borne by a second section of a composite frame, and such second section has legs resting on or being embedded in a foundation. A first section of the frame carries a motor for the pump and is carried by the casing. In addition, the two sections of the frame are connected to each other to partially surround and confine the casing against radial expansion in response to increasing internal pressures, and the sections are held against each other so that they are maintained under an initial stress which opposes elastic deformation of the casing. The weight of the motor is transmitted directly to the foundation.

11 Claims, 2 Drawing Sheets

FRAME FOR PUMP-MOTOR ASSEMBLIES

BACKGROUND OF THE INVENTION

The invention relates to improvements in pump-motor assemblies, especially in assemblies wherein a motor is used to drive a centrifugal pump. More particularly, the invention relates to improvements in frames for pump-motor assemblies and to improvements in means for and in methods of installing pump-motor assemblies in such frames.

The casings of centrifugal pumps are often subjected to pronounced internal pressures. In order to ensure that the casing of a centrifugal pump will be capable of standing such stresses, it is customary to provide the casing with external reinforcing ribs or to increase the thickness of the casing. Such expedients are also resorted to if the casing is large. These undertakings are intended to prevent expansion of the casing in the event of pronounced internal pressures, to prevent such extensive deformation of the casing that the casing is likely to come in contact with the impeller or impellers and/or to prevent the development of cracks in certain regions of the casing, particularly in the region of the so-called spurs. Reference may be had, for example, to German Auslegeschrift No. 1 135 765 of Klaus (published Aug. 30, 1962). A drawback of the proposal of Klaus is that the pump casing is very expensive, even if the casing constitutes a casting. It is necessary to make complex and expensive cores and patterns which are utilized to carry out the casting operation.

Another prior proposal to reinforce the casing of the pump in a pump-motor assembly or aggregate is disclosed in British Pat. No. 911,769 granted Nov. 28, 1962 to Jönköpings Mekaniska Werkstadts Aktiebolag. This publication discloses a frame which resembles a tripod having three legs resting on a base and supporting the motor of the pump-motor assembly from below. The casing of the pump is suspended from the frame and is disposed between the legs. The patented assembly is bulky and the frame is incapable of ensuring that the pump casing will indeed stand pronounced internal pressures. The reason is that the frame merely serves as a means for propping the motor from below and for releasably holding the pump casing in suspended condition.

OBJECTS OF THE INVENTION

An object of the invention is to provide a pump-motor assembly which is constructed, assembled and mounted in such a way that the pump casing can stand pronounced internal stresses.

Another object of the invention is to provide a novel and improved frame for the pump and for the motor of a pump-motor assembly, particularly an assembly wherein the motor serves to drive the impeller or impellers of a centrifugal pump.

A further object of the invention is to provide a compact frame which contributes little to the bulk but greatly enhances the stability of the pump-motor assembly.

An additional object of the invention is to provide a novel and improved mode of reinforcing the casing of a centrifugal pump.

Still another object of the invention is to provide an assembly wherein the pump casing can be reinforced to a desired degree and in any one of a number of different ways.

A further object of the invention is to provide an assembly wherein the pump casing can be reinforced at locations which are most likely to necessitate reinforcement in the event of the development of pronounced internal pressures.

Another object of the invention is to provide a simple, compact and inexpensive reinforcing frame which can be utilized in the above outlined assembly.

An additional object of the invention is to provide novel and improved sections which can be assembled into a frame of the above outlined character.

Still another object of the invention is to provide a frame which can be used in conjunction with existing pump-motor assemblies.

A further object of the invention is to provide an assembly wherein the motor and the pump are readily accessible for inspection, repair or replacement.

Another object of the invention is to provide a novel and improved combination of a pump casing and a frame of the above outlined character.

An additional object of the invention is to provide a novel and improved combination of a motor and a frame of the above outlined character.

SUMMARY OF THE INVENTION

The invention is embodied in a pump-motor assembly which comprises a pump (for example, a centrifugal pump) including a casing, a motor (e.g., an electric motor) which is connected with the pump, and a frame surrounding at least a portion of the casing and comprising a plurality of sections including a first section mounting the motor and a second section mounted on a support. The sections have neighboring outer portions at the casing, and the second section carries the casing. The first section is borne by the casing and the sections are or can be at least slightly resilient and are affixed to each other.

The neighboring outer portions of the first and second sections can be provided with substantially coplanar abutting surfaces.

The pump can include at least one rotary impeller which is installed in the casing and has a radially outermost portion. The arrangement can be such that the casing carries the first section of the frame and is borne by the second section in the region of the radially outermost portion of the at least one impeller.

The at least one impeller is rotatable in the casing about a predetermined axis (e.g., about a vertical axis), and the aforementioned portion of the casing can be disposed at a first radial distance from the predetermined axis less than the distance of such axis from the neighboring outer portions of the first and second sections.

The support for the second section can form part of the improved frame.

The first and second sections preferably comprise first and second annular portions, respectively, which abut or are at least close to the casing. At least one of the first and second sections can include at least one rib or another suitable reinforcing element preferably extending between the respective annular and outer portions. Each outer portion can include two parts which are disposed substantially at diametrically opposite sides of the respective annular portion.

The arrangement is or can be such that the first and second sections are at least partially and at least slightly separable from each other and that the casing is turnable in the frame upon such at least partial separation of the first and second sections from one another.

The casing can be provided with one or more projections resting on the at least one reinforcing portion of the second section.

At least one of the first and second sections can comprise a plurality of components which are bonded (e.g., welded) to each other.

The novel features which are considered as characteristic of the invention are set forth in particular in the appended claims. The improved assembly itself, however, both as to its construction and the mode of installing the same, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
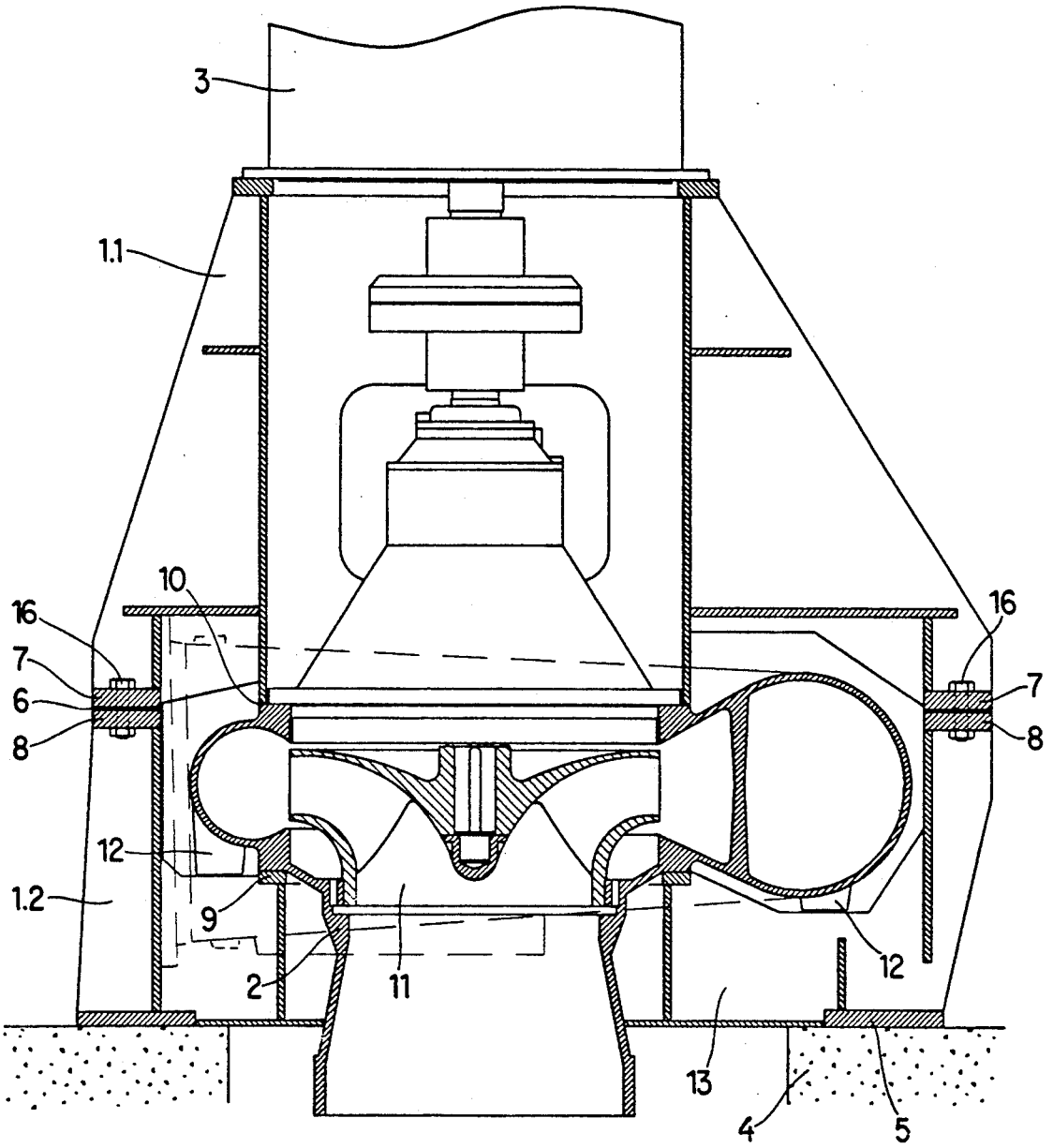
FIG. 1 is a fragmentary central sectional view of a pump-motor assembly which embodies one form of the invention and wherein the motor is mounted on the first section of the frame to rotate the impeller of the pump about a vertical axis.

The pump-motor assembly which is shown in the drawings comprises a centrifugal pump having a casing 2 and an impeller 11 which is rotatable in the casing about a vertical axis, a motor 3 which is connected with the pump and serves to drive the impeller 11, and a frame including a first or upper section 1.1 which supports the motor 3 and a second or lower section 1.2 which bears the section 1.1 as well as the pump casing 2 and is mounted on a support 4, e.g., a fixed base. This support or base 4 can be said to form part of the frame which includes the sections 1.1 and 1.2. As can be best seen in FIG. 2, the sections 1.1 and 1.2 surround a portion of the casing 2 and respectively have radially outer portions 7 and 8 each including two parts with surfaces abutting each other in a horizontal plane 6. The outer portions 7 and 8 are disposed radially outwardly of the radially outermost portion of the impeller 11 in the casing 2. The section 1.1 further comprises an annular portion 10 (e.g., in the form of a circumferentially complete ring) which is carried by the casing 2, and the section 1.2 includes an annular portion 9 (e.g., a circumferentially complete ring) which bears the casing 2.

The drawings show a relatively simple frame which includes only two sections 1.1 and 1.2. It is to be understood, however, that the number of sections can be increased to three or more, e.g., by halving each of the illustrated sections 1.1 and 1.2.

The weight of the motor 3 is borne by the section 1.1, and such weight is transmitted to the base 4 through the section 1.2. To this end, the section 1.2 has foot plates 5 which abut the support or base 4 and can be permanently or separably affixed thereto. The mode of installing the motor 3 and the casing 2 in the frame need not be appreciably changed if the assembly is installed to have the impeller 11 of the centrifugal pump rotate about a substantially horizontal axis.

Figure 2:
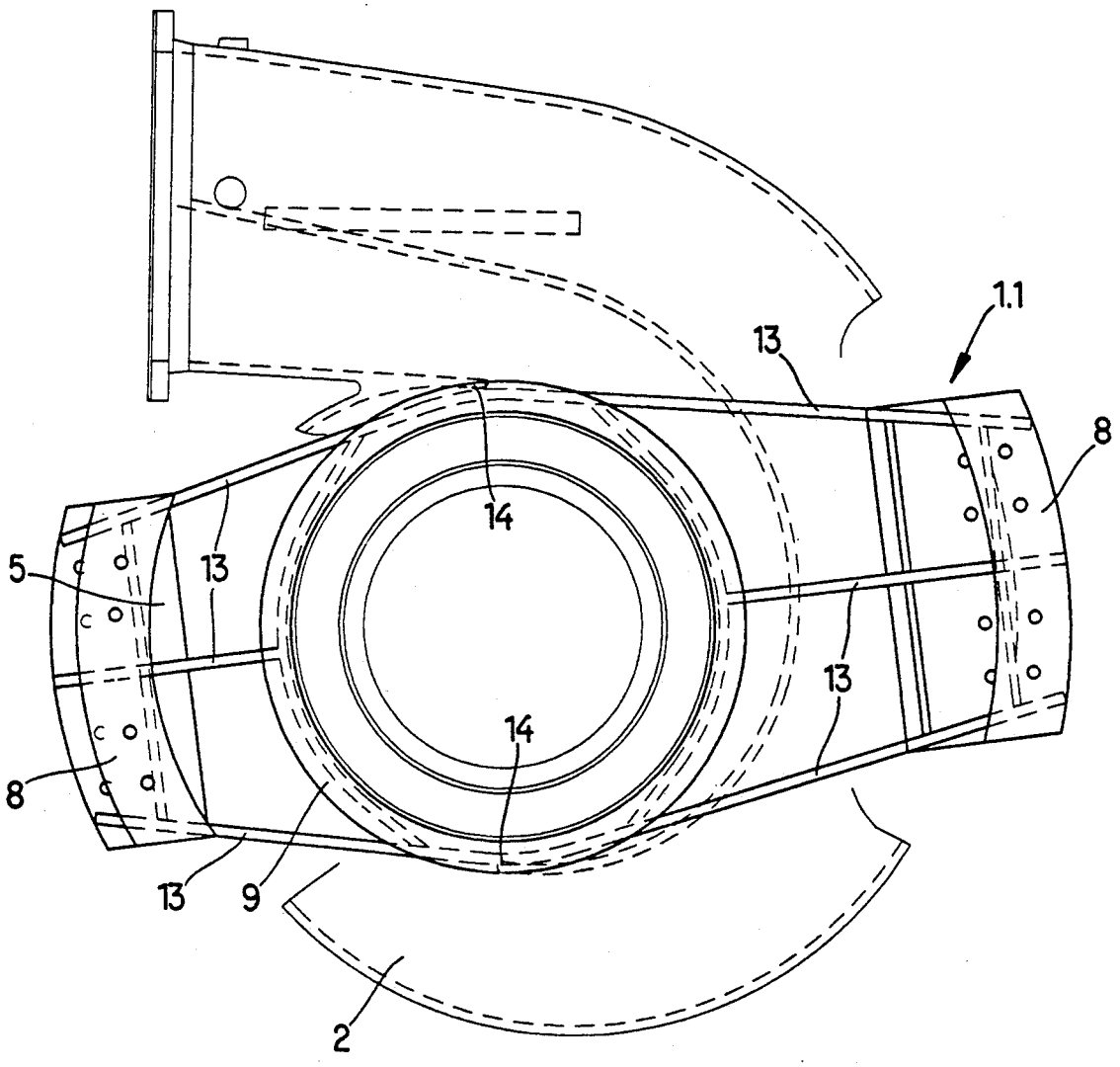
FIG. 2 is a plan view of the second section of the frame, the casing of the pump being indicated in part by broken lines.

The two parts of the radially outer portion 7 of the section 1.1 are located at diametrically opposite sides of the annular portion 10, and the two parts of the outer portion 8 of the section 1.2 are disposed at diametrically opposite sides of the annular portion 9 (see FIG. 2). The radially outer portions 7 and 8 are or can be bolted or otherwise reliably secured to each other (as at 16) and each of these sections is or can be at least slightly resilient to such an extent that, if the connection between the outer portions 7 and 8 (across the plane 6) is slightly relaxed, (to develop a narrow gap between the outer portions 7 and 8), the casing 2 can be turned in the frame, particularly about the axis of the impeller 11.

The annular portions 10, 9 of the sections 1.1 and 1.2 are located radially outwardly of the radially outermost portion of the impeller 11.

When the outer portions 7, 8 are bolted (at 16) or otherwise affixed to each other to reduce the width of the aforediscussed gap at the plane 6 to zero, the sections 1.1 and 1.2 surround a substantial portion of the casing 2 with a force which ensures that the casing is held against undue or undesirable expansion and/or other deformation, even if the chamber for the impeller 11 is maintained at an elevated pressure. Moreover, the sections 1.1 and 1.2 cooperate with the bolts 16 which connect the outer portions 7, 8 to each other so as to prevent any cracking or similar damage to the casing 2 in the region of the so-called spurs 14 which are shown in FIG. 2. The latter further shows that the illustrated casing 2 is a so-called twin volute centrifugal pump casing.

The casing 2 is further provided with one or more projections 12 which rest on reinforcing braces or otherwise configurated reinforcing members 13 of the section 1.2. The reinforcing members 13 can extend between the annular portion 9 and the two parts of the outer portion 8 of the section 1.2. By bearing against the reinforcing portions 13, the projections 12 of the casing 2 ensure that the combined weight of the section 1.1, case 2 and pump 3 is transmitted to the base 4, preferably at a plurality of suitably distributed locations. Reinforcing members similar to those shown at 13 on the section 1.2 can also be provided on the section 1.1 of the improved frame.

As can be seen in FIG. 2 for the portion 9, the annular portions 10 and 9 of the sections 1.1 and 1.2 can be dimensioned and positioned in such a way that they overlie the aforementioned spurs 14 of the casing 2. This ensures that the forces which are applied to the casing 2 by the sections 1.1 and 1.2 of the improved frame are particularly felt in those critical regions of the casing (such as at 14) which are most likely or more likely to undergo undesirable deformation or even suffer permanent damage if the pressure in the pump rises above a certain value. The improved frame acts not unlike a clamp which engages the casing 2 from the outside and renders it possible to avoid the utilization of an extremely heavy, bulky, strongly reinforced and expensive casing even if the pump develops very high internal pressures. This constitutes one of several important and desirable features of the improved pump-motor assembly. Another important feature is that the frame acts not unlike an enclosure or cage for the casing 2 and is or can be designed to ensure adequate reinforcement of one or more casing portions which are most likely to be adversely affected by elevated internal pressures. A further desirable feature of the improved assembly is that the sections 1.1 and 1.2 of the frame can exhibit adequate elasticity to yield to a selected degree in response to pronounced internal stressing of the casing 2. Still further, the connection (at 16) between the outer portions 7, 8 of the sections 1.1 and 1.2 can be established in such a way that the sections are stressed, i.e., they bear against the casing 2 and act not unlike a clamp which opposes radial expansion and/or other deformation of the casing 2 in response to a rise of internal pressure. The initial stressing or prestressing of the sections 1.1 and 1.2 can be selected in such a way that the sections prevent any, or greatly reduce the extent of, elastic deformation of the casing 2. This is often desirable in order to prevent cracking of the casing 2 in actual use of the pump-motor assembly. Such initial stressing of the sections 1.1 and 1.2 can be achieved by appropriate selection of their dimensions in unstressed condition so that the application of bolts 16 to the outer portions 7,8 of the sections 1.1 and 1.2 across the plane 6 entails a requisite elastic deformation of the sections and a corresponding initial stressing of the casing 2.

For example, the casing 2 of the centrifugal pump can be of the so-called radial or semiaxial (mixed flow) design. The position of the plane 6 is selected in such a way that it intersects the casing 2 when the sections 1.1 and 1.2 of the frame are properly assembled with each other.

The foot plates 5 of the section 1.1 can merely abut the support 4, or they can be embedded in the support so that the latter then constitutes a part of the improved frame.

At least one of the sections 1.1 and 1.2 can be assembled of several smaller parts which are bonded, preferably welded, to each other. FIG. 1 shows that each of the illustrated sections 1.1 and 1.2 is assembled of several components which are bonded to one another.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A pump-motor assembly comprising a centrifugal pump including a casing; a motor connected with said pump and a frame surrounding at least a portion of said casing and including a first section mounting said motor and a second section mounted on a support, said sections having neighboring outer portions at approximately the height of said casing and said second section carrying said casing, said first section being borne by said casing and said sections being at least slightly resilient and being affixed to each other.

2. The assembly of claim 1, wherein said neighboring outer portions have substantially coplanar abutting surfaces.

3. The assembly of claim 1, wherein said pump further includes a rotary impeller installed in said casing and having a radially outermost portion, said casing carrying said first section and being supported by said second section in the region of said radially outermost portion of said impeller.

4. The assembly of claim 1, wherein said pump further includes an impeller rotatable in said casing about a predetermined axis, said portion of said casing being disposed at a first radial distance from said axis and said neighboring outer portions of said sections being located at a greater than said first radial distance from said axis.

5. The assembly of claim 1, wherein said support is part of said frame.

6. The assembly of claim 1, wherein said sections respectively comprise first and second substantially annular portions which abut said casing.

7. The assembly of claim 6, wherein at least one of said sections includes at least one reinforcing element extending between the respective annular and outer portions.

8. The assembly of claim 6, wherein each of said outer portions includes two parts disposed substantially at diametrically opposite sides of the respective annular portion.

9. The assembly of claim 1, wherein said sections are at least partially separable.

10. The assembly of claim 1, wherein said casing comprises at least one projection resting on at least one reinforcing portion of said second section.

11. The assembly of claim 1, wherein at least one of said sections comprises a plurality of components which are bonded to each other.

* * * * *